United States Patent [19]

King

[11] 4,170,335

[45] Oct. 9, 1979

[54] INFINITELY ADJUSTABLE SUPPORT BRACKET

[75] Inventor: Harold L. King, Liberty, Mo.

[73] Assignee: William C. Rodgers, Maryland Heights, Mo.

[21] Appl. No.: 907,604

[22] Filed: May 19, 1978

[51] Int. Cl.[2] ..... A47G 29/02

[52] U.S. Cl. ..... 248/246; 248/295 A

[58] Field of Search ..... 248/244, 245, 246, 295 R, 248/295 A, 295 B, 295 C

[56] References Cited

U.S. PATENT DOCUMENTS

| | | | |
|---|---|---|---|
| 2,727,711 | 12/1955 | Bally | 248/246 |
| 3,865,337 | 2/1975 | Towfigh et al. | 248/246 |

FOREIGN PATENT DOCUMENTS

| | | | |
|---|---|---|---|
| 2102834 | 7/1971 | Fed. Rep. of Germany | 248/246 |
| 1197532 | 6/1959 | France | 248/246 |
| 514999 | 2/1955 | Italy | 248/246 |
| 4361 | of 1913 | United Kingdom | 248/246 |

*Primary Examiner*—Lawrence J. Staab

*Attorney, Agent, or Firm*—Fishburn, Gold & Litman

[57] ABSTRACT

An infinitely adjustable support bracket includes an elongate upright member having an interior way and spaced opposite side walls, a rear wall and spaced front flanges defining a slot open to the interior way. An arm member extends outwardly of the slot and has an end with a plate diagonally connected thereto which is received within the interior of the upright member. The plate is slidable within the way of the upright member when the arm is swung to an upwardly inclined relation thereto and is fixed in diagonally lodged position within the upright member for load-bearing support when the arm member is substantially normal thereto, positioning opposed edges of the plate in engagement with rear and front inner surface of the upright member. A resilient spring is provided which is connected to the arm member and engages the interior of the upright member and urges return of the plate into a diagonally lodged position when the arm is swung upwardly.

2 Claims, 5 Drawing Figures

INFINITELY ADJUSTABLE SUPPORT BRACKET

This invention relates to a support bracket for shelves, equipment, display items or the like, and in particular to a support bracket which is infinitely adjustable in height position.

Many prior art support bracket structures for shelving utilize a series of spaced lugs and recesses in an upright member and support arm which provide selective interengagement for height of a support arm. None, however, are known to provide the operational advantages of the present infinitely adjustable support bracket.

The principal objects of the present invention are: to provide a structure that permits infinite height adjustment of a support bracket; to provide such a support bracket or arm which is easily assembled and disassembled to an upright member; to provide such a support bracket structure including a column with a way therein and an arm with a plate having opposed edges or detents for holding engagement with inside surfaces defining said way for securing the arm in selected position in response to loads on said arm; to provide such a support bracket structure in which an arm member thereof undergoes an increase in supporting force as loads are applied to the ends of the arm member; to provide such a support bracket structure including a resilient spring connected to the arm member and urging the same into a fixed position relative to the support bracket wherein said opposed edges or detents have holding engagement with inside surfaces of the column; and to provide such a support bracket which is relatively inexpensive, sturdy and efficient in use and particularly well adapted for its intended purpose.

Other objects and advantages of this invention will become apparent from the following description taken in connection with the accompanying drawings wherein are set forth, by way of illustration and example, certain embodiments of this invention.

FIG. 1 is a side elevational view of an infinitely adjustable support bracket embodying the present invention and is shown with an arm member thereof in fixed position.

FIG 2. is a side elevational view of the preferred embodiment of the support bracket and including a resilient spring urging the arm into a supportive position.

Figure 1:
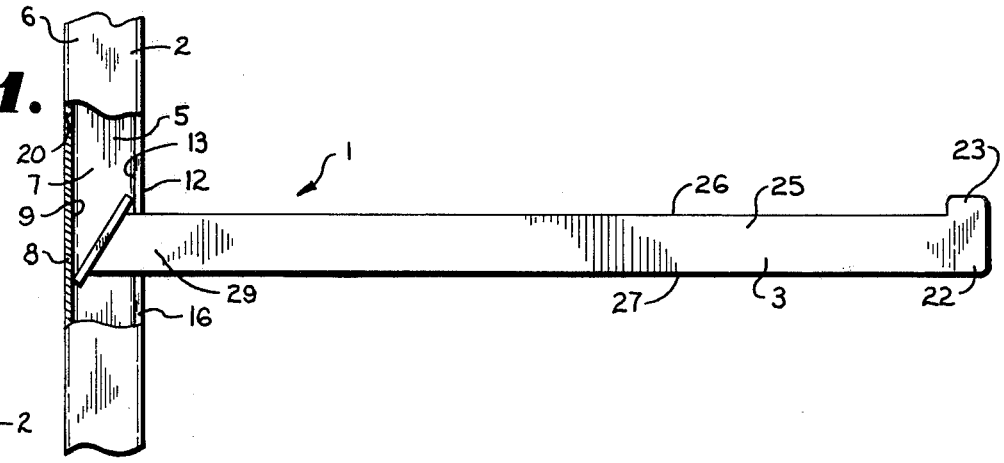

Referring to the drawings in more detail:

As required, detailed embodiments of the present invention are disclosed herein, however, it is to be understood that the disclosed embodiments are merely exemplary of the invention which may be embodied in various forms, therefore, sppecific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates an infinitely adjustable support bracket structure embodying the present invention. The support bracket structure 1 includes an upright, elongate, hollow or channeled column or member 2 from which extends an arm member 3 which is infinitely variable in position along the length of the channeled member 2.

The channeled member 2 has an interior or way 5 defined by spaced, opposite side walls 6 and 7, a rear wall 8 which extends between the side walls 6 and 7, said rear wall having an interior surface 9. The channelled member 2 also has a pair of collinearly aligned front flange members 11 and 12 which have respective interior surfaces 13 and free edges 15 and 16 spaced from each other and defining an elongate slot 18 extending the length of the channeled member 2 and open to the interior or way 5 thereof.

Figure 5:
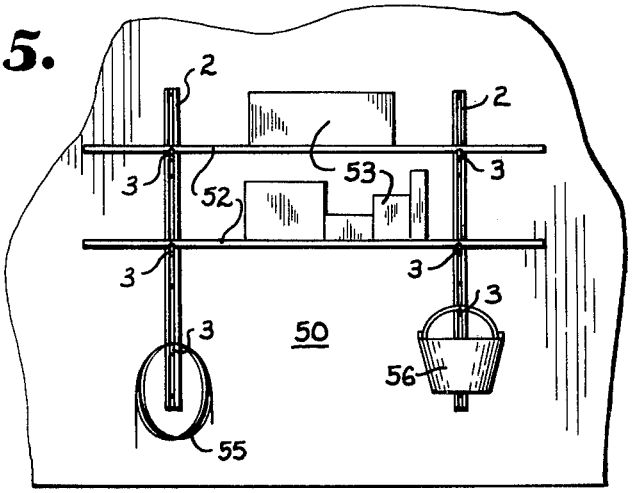
FIG. 5 is a front elevational view of a shelf-supporting arrangement including a pair of infinitely adjustable support brackets.

The channeled member 2 is adapted to be mounted in an upright position and includes means for securing same in said position and, in the illustrated example, includes spaced bores 20 with countersunk portions through which fasteners, such as screws 21 may be extended to mount the channeled member 2 to an upright support, such as a wall, FIG. 5. It is preferred that a fastener 21 include a tapered head for flat and smooth receipt into the coordinating countersunk portion of bore 20 whereby the same does not project outwardly of the interior surface of the rear wall 9 and into the channeled member interior or way 5.

A load supporting structure, such as, in the illustrated example, an arm member 3 extends outwardly of the channeled member 2 through the slot 18 and, in the illustrated example, comprises an elongate, rigid, planar strap or bar having opposite surfaces 25 and upper and lower edges 26 and 27. A free end 22 thereof includes an upward protruding lip portion 23 providing a stop for resisting sliding movement of an object, such as a shelf, off the free end 22.

The arm member 3 is engaged in a selected position within the interior or way 5 of the upright channeled member 2. In the illustrated example, an arm end 29 positioned within the interior or way 5 is diagonally connected to a latch portion, such as a plate 30. The exemplary plate 30 is substantially rectangular and has front and rear edges 31 and 32 opposite side edges 33, and top and bottom surfaces 34 and 35. The arm member end 29 is angularly connected to the bottom surface 35 of the plate 30 so that the length dimension of the plate 30 extends at an incline of approximately 45 degrees to the length dimensions or longitudinal axis of the arm member 3. The plate 30 is angled upwardly with its front edge 31 toward the arm upper edge 26 and forms an acute angle therewith. Conversely, the plate rear edge 32 extends away from the arm lower edge 27 and forms an obtuse angle therewith. Furthermore, the width dimension or transverse axis of the plate 30 extends substantially transversely to the length dimension or longitudinal axis of the arm member 3.

The plate 30, received within the interior or way 5 of the channeled member 2, is freely slidable therein when the arm member 3 is swung upwardly in relation to the channeled member 2, and fixed in a diagonally lodged or wedged position in the interior or way 5 when the arm member 3 is substantially normal to the channeled member 2.

The plate 30 has a width dimension commensurate with the interior or way 5 and extends substantially the distance between the opposed, spaced, side walls 6 and 7. Significantly, the plate 30 has a length dimension greater than the normal dimension of the channeled member interior or way 5 between the rear wall interior surface 9 and the interior surfaces 13 of the flanges 11 and 12. Necessarily, the dimensions of the plate 30 will not permit the same to rotate transversely or completely crossways to the longitudinal axis of the interior or way 5 and will only permit rotation of the plate 30 until the top surface 34 extends angularly between the interior surface of the rear wall 9 and the interior surfaces 13 of the flanges 11 and 12 in an acute upward angle of approximately 45 degrees from the rear wall interior surface 9.

In particular, the plate front and rear edges 31 and 32, when the arm member 3 is swung downwardly to assume a normal position relative to the channeled member 2, rotate into wedging or lodging engagement within the channeled member interior or way 5 with the front edge 31 and the rear edge 32 engaged against respective flange interior surfaces 13 and the rear wall interior surface 9.

The arm member 3 acts as a lever to rotate the plate 30 about a horizontal axis extended through the arm end 29 to urge the front edge 31 into even tighter engagement with the flange interior surfaces 13 and concurrently push the rear edge 32 against the rear wall interior surface 9. It will be appreciated that the greater is the weight upon the arm member 3 towards the free end 22, the greater are the engagement forces.

Additionally, the spaced opposite side walls 6 and 7 act as lateral movement limiting members to retain the plate 30 laterally within the interior or way 5 and within engagement relation to the interior surfaces 9 and 13.

Figure 2:
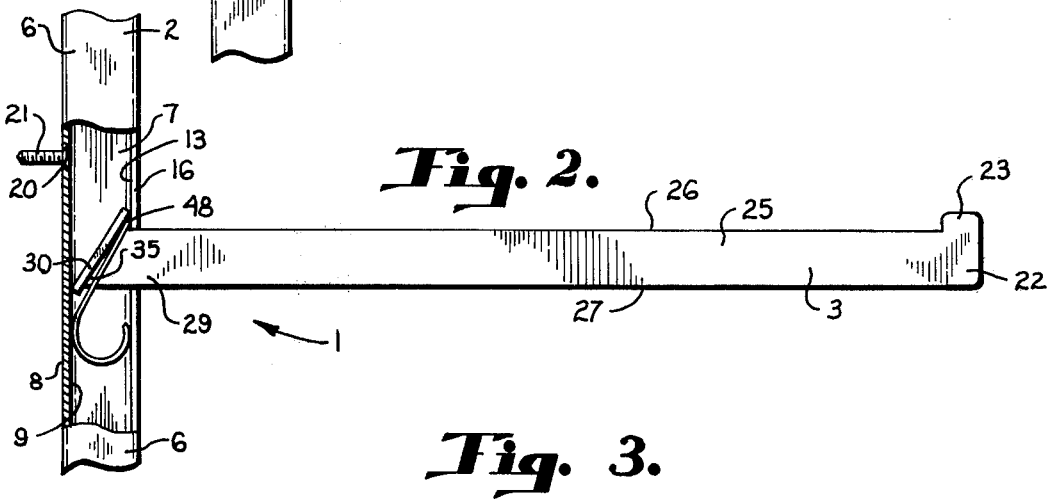
Figure 3:
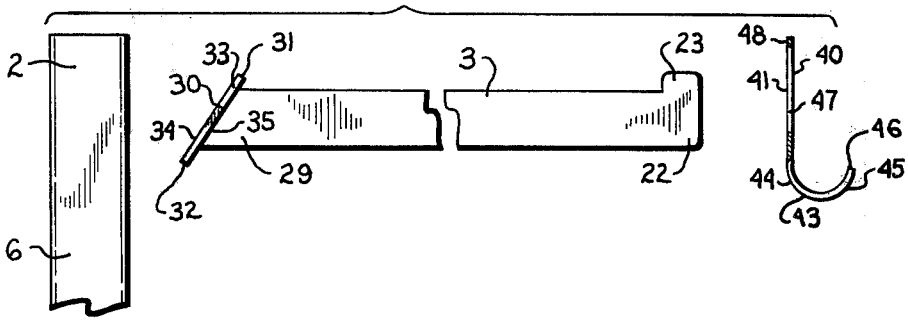
FIG. 3 is a disassembled view of the support bracket.
Figure 4:
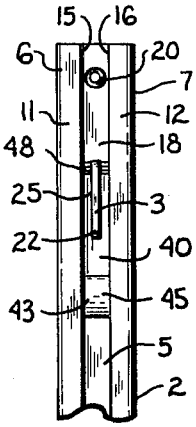
FIG. 4 is a front elevational view of the support bracket.

In the preferred embodiment of the invention, FIGS. 2, 3 and 4, a resilient means is connected to the arm member 3 and the channeled member 2 and urges the arm member 3 into a position substantially normal to the channeled member 2 for diagonally lodging the plate 30 into position and securing the arm member 3 from downward slipping movement.

In the illustrated example, the resilient means includes a spring member 40 having an arm portion 41 and a hook portion 43 which includes a rear surface 44 and a projecting front surface 45 for respectively engaging the rear wall interior surface 9 and the flange member interior surface 13. An elongate slot 47 of commensurate size to receive the arm member free end 22 therethrough extends through the spring member arm portion 41. The spring arm portion 41 is sleeved over the arm member 3 with an upper end 48 of the spring member 40 engaging the upper edge 26 of the arm member 3 adjacent the plate bottom surface 35.

When the plate 30 and the accompanying spring member 40 are received within the channeled member interior or way 5, the hook portion and front rear srufaces 45 and 44 engage the front and rear channeled member interior surfaces 13 and 9 which slightly compress the hook portion 43 therebetween. Upon insertion, the compressed hook portion 43 causes the arm portion upper end 48 to rotate forwardly and downwardly, urging the plate front edge 31 against the flange member interior surface 13.

When the free end 22 of the arm member 3 is swung upwardly relative to the channeled member 2, as by inadvertantly contacting the arm member 3, the bottom surface 35 of the plate 30 adjacent the rear edge 32 swings against the arm portion 41 and toward the rear surface 44 and thereby resiliently urges the arm portion upper end 48 upwardly and rearwardly. Without the spring member 40, it will be appreciated that upward swinging movement of the arm free end 22 relative to the channeled member 2 disengages the front and rear edges 31 and 32 from lodging contact with the respective inner surfaces 13 and 9 and allows the plate 3 to slide downwardly in the channeled member interior 5. However, the spring member 40 tends to catch the arm member 3 and prevents substantial downward sliding thereof. The spring arm portion uppper end 48, once moved upwardly and rearwardly by the arm member 3 tends to rotate or swing the arm member 3 into a fixed position and diagonally lodge the plate 30 within the channeled member interior or way 5.

Thus, it will be appreciated that the spring member 40 provides a preferred orientation of the arm member 3 normal to the channeled member 2 and fixed in position relative to same when the former is either intentionally or inadvertently rotated upwardly at its free end 22, such as by bumping thereagainst.

In the use of the invention as in the illustrated example, FIG. 5, a pair of elongated channeled members 2 are positioned in parallel, upright spaced relationship and mounted to a support, such as a wall 50. A plurality of arm members 3 having plates 30 respectively connected thereto are received within the channeled members 2 and extend normally therefrom. As illustrated, the arms 3 may be adjusted to levelly support shelves 52 extended therebetween and supporting a plurality of materials, such as boxes or cartons 53 or the like. Additionally, unpaired arm members 3 can be used to support individual items such as hoses 55, buckets 56 or the like. The arm members 3 may be maintained in the illustrated positions relative to the channeled members 2 or may be moved upwardly or downwardly therein as described above. It will be appreciated that, particularly when levelly aligning respective laterally spaced pairs of arm members 3, all that is needed to correctly adjust the same is an ordinary bubble level or the like device because each of the arm members 2 is infinitely adjustable within the channeled member 2 and accordingly, can be positioned in load supporting engagement any place therealong.

It is to be understood that while one form of this invention has been illustrated and described, it is not to be limited to the specific form or arrangement of parts herein described and shown, except insofar as such limitations are included in the follwing claims.

What is claimed and desired to secure by Letters Patent is:

1. An infinitely adjustable support structure comprising:

(a) an upright member fixed in position and having an interior way with spaced, opposed, front and rear surfaces and an elongate opening;

(b) a bracket member having an elongate arm with a latch portion at one end, said latch portion being in said interior way and said arm extending forwardly therefrom through said opening;

(c) said latch portion being in fixed relation to said arm and inclined relative thereto with opposed edges for holding engagement with said front and rear surfaces respectively in response to a load on said arm;

(d) a resilient member connected to the arm and the latch portion and having a gripping portion extended therefrom, said gripping portion resiliently engaging said front and rear surfaces and exerting pressure on said latch portion to urge same into inclined relationship; and (e) said arm being released for vertical movement when said arm is raised, releasing said opposed edges of said latch portion from engagement with said front and rear surfaces, and whereby the resilient member urges downward rotation of the arm in response to raising the arm for re-engagement of said latch portion with said front and rear surfaces.

2. An infinitely adjustable support bracket structure comprising:

(a) an upright, elongate, channeled member having an interior way defined by spaced, opposite, side walls, a rear wall having an interior surface and extending between said side walls and a pair of collinearly aligned front flanges having interior surfaces and connected to said side walls, said front flanges having respective free edges spaced from each other and defining an elongate slot open to the interior way of said channeled member;

(b) means for maintaining said channeled member in upright position;

(c) an arm member extended outwardly from said slot and infinitely variable in position therealong, said arm member extended from a plate having front and rear edges and top and bottom surfaces, said arm member being diagonally connected to said plate at said bottom surface, said plate being slidable in the interior way of said channeled member when said arm member is swung upwardly relative thereto and fixed in diagonally lodged position in the interior way of said channeled member when said arm member is substantially normal thereto with said front edge in engagement with said front flanges interior surfaces and said rear edge in engagement with said rear wall interior surface and with the weight of said arm member tending to rotate said plate edges into engagement position;

(d) a resilient means connected to said arm member and said channeled member and urging said arm member to a position substantially normal to said channeled member; and (e) said resilient means includes a spring member having an arm portion engaging said arm member, said arm portion extending from a hook portion having a rear portion engaging the interior of said rear wall and a front portion engaging the interior surfaces of said front flange member, said arm portion being resilient relative to said hook portion and exerting downward rotational force on said arm member in response to upwardly swinging movement of said arm relative to said channeled member.

* * * * *